US007596974B2

(12) United States Patent
Smith et al.

(10) Patent No.: US 7,596,974 B2
(45) Date of Patent: Oct. 6, 2009

(54) INSTANT STAIN REMOVING DEVICE, FORMULATION AND ABSORBENT MEANS

(75) Inventors: Leland J. Smith, Midland, MI (US); Michael J. Banco, Racine, WI (US); Douglas A. Soller, Racine, WI (US); Roberta A. Wick, Racine, WI (US); Jeanne A. O'Brien, Racine, WI (US); Christopher R. Sheridan, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 300 days.

(21) Appl. No.: 11/564,376

(22) Filed: Nov. 29, 2006

(65) Prior Publication Data

US 2007/0289071 A1 Dec. 20, 2007

Related U.S. Application Data

(60) Provisional application No. 60/805,159, filed on Jun. 19, 2006.

(51) Int. Cl.
*D06F 3/00* (2006.01)

(52) U.S. Cl. ..... 68/213; 134/201

(58) Field of Classification Search ..... 8/158; 68/213; 134/900; 401/208, 219, 197
See application file for complete search history.

(56) References Cited

U.S. PATENT DOCUMENTS

| | | | |
|---|---|---|---|
| 1,878,475 | A | 9/1932 | Driest |
| 2,164,965 | A | 7/1939 | Traube |
| 2,258,115 | A | 10/1941 | Kingman |
| 2,265,603 | A | 12/1941 | Kingman |
| 2,594,729 | A | 4/1952 | Carvalho |
| 2,666,555 | A | 1/1954 | Hill |
| 2,807,818 | A | 10/1957 | Taylor |
| 3,046,593 | A | 7/1962 | Goldman et al. |
| 3,124,825 | A | 3/1964 | Iovenko |
| 3,209,769 | A | 10/1965 | Gobin |
| 3,218,666 | A | 11/1965 | Espey |
| 3,256,549 | A | 6/1966 | Evesque |
| 3,356,095 | A | 12/1967 | Tylle |
| 3,628,876 | A | 12/1971 | Casey et al. |
| 3,682,558 | A | 8/1972 | Miller |

(Continued)

FOREIGN PATENT DOCUMENTS

DE 35 08 388 A1 9/1985

(Continued)

OTHER PUBLICATIONS

PCT/US2007/013897 International Search Report and Written Opinion dated May 27, 2008.

*Primary Examiner*—Michael Barr
*Assistant Examiner*—Jason Y Ko

(57) ABSTRACT

A device for applying stain formulation to a garment or article of clothing while it is being worn is disclosed. The device includes a reservoir with a valve assembly for dispensing an effective stain removal formulation directly to the stain, spot or mark. The device also includes a shell accommodating absorbent pads. After the stain removal formulation is applied, an absorbent pad is pressed and/or rubbed on the stain to lift and remove the stain and to absorb or wick excess fluid thereby reducing the amount of time the resulting wet spot takes to dry. Effective stain removing formulations for on-the-go use are also disclosed.

16 Claims, 10 Drawing Sheets

U.S. PATENT DOCUMENTS

| | | | |
|---|---|---|---|
| 3,686,125 | A | 8/1972 | Miller |
| 3,757,782 | A | 9/1973 | Aiken |
| 3,958,571 | A | 5/1976 | Bennington |
| 3,968,047 | A | 7/1976 | Smeets |
| D245,221 | S | 8/1977 | Hoyt |
| 4,053,243 | A | 10/1977 | Levin |
| 4,071,921 | A | 2/1978 | Jury |
| 4,076,698 | A | 2/1978 | Anderson et al. |
| 4,121,891 | A | 10/1978 | Barron |
| D250,436 | S | 12/1978 | Johnson |
| 4,218,155 | A | 8/1980 | Weidner |
| 4,289,153 | A | 9/1981 | Paccione |
| 4,336,024 | A | 6/1982 | Denissenko et al. |
| 4,596,481 | A | 6/1986 | Tanaka |
| 4,652,163 | A | 3/1987 | Karliner et al. |
| 4,723,860 | A | 2/1988 | Giblin et al. |
| 4,767,562 | A | 8/1988 | Fry |
| 4,776,836 | A | 10/1988 | Stanley |
| 4,799,815 | A | 1/1989 | Barabino et al. |
| 4,812,067 | A | 3/1989 | Brown et al. |
| 4,828,747 | A | 5/1989 | Rerek et al. |
| 4,842,762 | A | 6/1989 | Sabol, Jr. et al. |
| 4,849,117 | A | 7/1989 | Bronner |
| 4,854,761 | A | 8/1989 | Smith et al. |
| 4,884,913 | A | 12/1989 | Smith et al. |
| 4,966,483 | A | 10/1990 | Hashimoto et al. |
| 4,998,545 | A | 3/1991 | Hiromura |
| 4,998,839 | A | 3/1991 | Bashir |
| 5,006,004 | A | 4/1991 | Dirksing et al. |
| 5,013,485 | A | 5/1991 | Tsukuda et al. |
| 5,090,832 | A | 2/1992 | Rivera et al. |
| 5,098,297 | A | 3/1992 | Chari et al. |
| 5,108,643 | A | 4/1992 | Loth et al. |
| 5,122,158 | A | 6/1992 | Kuroda et al. |
| 5,244,593 | A | 9/1993 | Roselle et al. |
| 5,252,243 | A | 10/1993 | Minns |
| 5,358,349 | A | 10/1994 | Burroughs |
| 5,362,412 | A | 11/1994 | Hartman |
| 5,382,376 | A | 1/1995 | Michael et al. |
| 5,393,468 | A | 2/1995 | Erilli et al. |
| 5,403,587 | A | 4/1995 | McCue et al. |
| 5,449,474 | A | 9/1995 | Lucas et al. |
| 5,490,736 | A | 2/1996 | Haber et al. |
| 5,509,742 | A | 4/1996 | Balzarini |
| 5,522,580 | A | 6/1996 | Varner, Jr. et al. |
| 5,540,227 | A | 7/1996 | Poole |
| 5,555,673 | A | 9/1996 | Smith |
| 5,573,710 | A | 11/1996 | McDonell |
| 5,577,850 | A | 11/1996 | Mishima |
| 5,585,033 | A | 12/1996 | Tsao et al. |
| 5,643,861 | A | 7/1997 | de Guertechin et al. |
| 5,684,025 | A | 11/1997 | Tsao et al. |
| 5,707,163 | A | 1/1998 | Gregory |
| 5,736,500 | A | 4/1998 | Farnworth et al. |
| 5,746,531 | A | 5/1998 | Izhak |
| 5,765,407 | A | 6/1998 | Choo et al. |
| 5,776,206 | A | 7/1998 | Kleber |
| 5,780,411 | A | 7/1998 | Erilli |
| 5,782,801 | A | 7/1998 | Caillouette |
| 5,791,801 | A | 8/1998 | Miller |
| 5,814,591 | A | 9/1998 | Mills |
| 5,817,585 | A | 10/1998 | Rose et al. |
| 5,840,675 | A | 11/1998 | Yeazell |
| 5,849,039 | A | 12/1998 | Sadlowski |
| 5,853,430 | A | 12/1998 | Shindo et al. |
| 5,861,365 | A | 1/1999 | Colurciello, Jr. et al. |
| 5,887,753 | A | 3/1999 | Poolman |
| 5,895,504 | A | 4/1999 | Sramek et al. |
| 5,899,624 | A | 5/1999 | Thompson |
| 5,927,884 | A | 7/1999 | Kao |
| 5,941,378 | A | 8/1999 | Rose et al. |
| 5,955,415 | A | 9/1999 | Gutierrez et al. |
| 5,962,391 | A | 10/1999 | Oldenhove |
| 5,971,645 | A | 10/1999 | Fukushima et al. |
| 5,972,876 | A | 10/1999 | Robbins et al. |
| 5,993,097 | A | 11/1999 | DeBaene |
| 5,997,585 | A | 12/1999 | Scialla et al. |
| 6,004,916 | A | 12/1999 | Mills |
| 6,037,317 | A | 3/2000 | Rapisarda et al. |
| 6,048,368 | A | 4/2000 | Tcheou et al. |
| 6,056,470 | A * | 5/2000 | Nehashi et al. ..... 401/279 |
| 6,059,477 | A | 5/2000 | Dunlap, Jr. et al. |
| 6,074,705 | A | 6/2000 | DeBaene |
| 6,087,312 | A | 7/2000 | Masotti et al. |
| 6,103,685 | A | 8/2000 | Hall |
| 6,113,654 | A | 9/2000 | Peterson |
| 6,145,513 | A | 11/2000 | Chu et al. |
| RE36,982 | E | 12/2000 | Melikyan et al. |
| 6,171,346 | B1 | 1/2001 | Yeazell et al. |
| 6,179,501 | B1 | 1/2001 | Fulop |
| 6,179,505 | B1 | 1/2001 | Oder, III et al. |
| 6,186,686 | B1 | 2/2001 | Neuner et al. |
| 6,213,129 | B1 | 4/2001 | Muldoon |
| 6,214,784 | B1 | 4/2001 | Robbins et al. |
| 6,233,771 | B1 | 5/2001 | Hortel et al. |
| 6,277,808 | B1 | 8/2001 | Tcheou et al. |
| 6,283,933 | B1 | 9/2001 | D'Alessio et al. |
| 6,316,399 | B1 | 11/2001 | Melikyan et al. |
| RE37,675 | E | 4/2002 | Gueret |
| 6,375,686 | B1 | 4/2002 | Kim |
| 6,376,444 | B1 | 4/2002 | Hortel et al. |
| 6,376,451 | B1 | 4/2002 | Teasdale et al. |
| 6,386,781 | B1 | 5/2002 | Gueret |
| 6,391,061 | B1 | 5/2002 | Hortel et al. |
| 6,407,051 | B1 | 6/2002 | Smith et al. |
| 6,440,909 | B1 | 8/2002 | Vignot |
| 6,491,840 | B1 | 12/2002 | Frankenbach et al. |
| 6,514,924 | B1 | 2/2003 | Van Hauwermeiren |
| 6,536,974 | B2 | 3/2003 | Redmond |
| 6,555,512 | B1 | 4/2003 | Coggeshall et al. |
| 6,593,279 | B2 | 7/2003 | Von Krosigk |
| 6,595,940 | B1 | 7/2003 | D'Alessio et al. |
| 6,644,879 | B2 | 11/2003 | Irvin |
| 6,689,730 | B2 | 2/2004 | Hortel et al. |
| 6,689,736 | B2 | 2/2004 | Thomas et al. |
| 6,692,173 | B2 | 2/2004 | Gueret |
| 6,693,068 | B1 | 2/2004 | Ryan et al. |
| 6,696,399 | B1 | 2/2004 | Chernin |
| 6,706,676 | B2 | 3/2004 | Swensen |
| 6,715,326 | B2 | 4/2004 | Price |
| 6,752,556 | B2 | 6/2004 | Pearce |
| 6,767,371 | B2 | 7/2004 | Ferguson et al. |
| 6,767,881 | B1 | 7/2004 | Griese et al. |
| 6,774,098 | B2 | 8/2004 | Taylor |
| 6,790,817 | B2 | 9/2004 | Gladfelter et al. |
| 6,811,338 | B1 | 11/2004 | Manske, Jr. et al. |
| 6,829,913 | B2 | 12/2004 | Goldoni |
| 6,832,867 | B2 | 12/2004 | Sandbach et al. |
| 6,838,423 | B2 | 1/2005 | Irvin |
| 6,841,090 | B1 | 1/2005 | Serego Allighieri et al. |
| 6,843,812 | B2 | 1/2005 | Stephanos |
| 6,846,332 | B2 | 1/2005 | Boissie et al. |
| 6,846,793 | B1 | 1/2005 | Griese |
| 6,883,353 | B2 | 4/2005 | Goldoni et al. |
| 6,893,469 | B1 | 5/2005 | Van Hauwermeiren et al. |
| 6,902,335 | B2 | 6/2005 | Bergey et al. |
| 6,905,276 | B2 | 6/2005 | Van Buskirk et al. |
| 6,939,839 | B2 | 9/2005 | Johnson |
| 6,982,243 | B2 | 1/2006 | Hazenkamp et al. |
| 7,012,052 | B1 | 3/2006 | Kluesener et al. |
| 7,012,054 | B2 | 3/2006 | Binder et al. |
| 7,030,069 | B2 | 4/2006 | Gupta et al. |
| 7,047,582 | B2 | 5/2006 | Moe et al. |
| 7,144,177 | B2 | 12/2006 | Van Buskirk et al. |

| | | | | |
|---|---|---|---|---|
| 2001/0005915 | A1 | 7/2001 | Naghi et al. | |
| 2002/0068014 | A1 | 6/2002 | Haught et al. | |
| 2002/0090251 | A1 | 7/2002 | Sandbach et al. | |
| 2002/0091070 | A1 | 7/2002 | Engisch et al. | |
| 2002/0178507 | A1 | 12/2002 | Goldoni et al. | |
| 2002/0178508 | A1 | 12/2002 | Goldoni et al. | |
| 2002/0178510 | A1 | 12/2002 | Goldoni et al. | |
| 2002/0178511 | A1 | 12/2002 | Goldoni et al. | |
| 2002/0183225 | A1 | 12/2002 | Goldoni et al. | |
| 2003/0004087 | A1 | 1/2003 | Goldoni et al. | |
| 2003/0019046 | A1 | 1/2003 | Boissie et al. | |
| 2003/0087781 | A1 | 5/2003 | Van Hauwermeiren et al. | |
| 2003/0145634 | A1 | 8/2003 | Price | |
| 2003/0216268 | A1 | 11/2003 | Swensen | |
| 2004/0084063 | A1 | 5/2004 | Vago et al. | |
| 2004/0097395 | A1 | 5/2004 | Crutzen | |
| 2004/0152616 | A1 | 8/2004 | Murphy et al. | |
| 2004/0168275 | A1 | 9/2004 | Goldoni et al. | |
| 2004/0180804 | A1 | 9/2004 | Johnson | |
| 2004/0217310 | A1 * | 11/2004 | Trappa | 251/96 |
| 2004/0231061 | A1 | 11/2004 | Irvin et al. | |
| 2005/0066996 | A1 | 3/2005 | France et al. | |
| 2005/0086761 | A1 | 4/2005 | Shenouda | |
| 2005/0111900 | A1 | 5/2005 | Fazzolari et al. | |
| 2005/0119151 | A1 | 6/2005 | Mayer et al. | |
| 2005/0147455 | A1 | 7/2005 | Muhr-Sweeney | |
| 2005/0164903 | A1 | 7/2005 | Ko et al. | |
| 2005/0186013 | A1 | 8/2005 | Oike | |
| 2005/0197268 | A1 | 9/2005 | Buskirk et al. | |
| 2005/0199265 | A1 | 9/2005 | France et al. | |
| 2005/0239675 | A1 | 10/2005 | Makansi | |
| 2005/0250668 | A1 | 11/2005 | Serobian et al. | |
| 2005/0251944 | A1 | 11/2005 | Buskirk et al. | |
| 2006/0030513 | A1 | 2/2006 | Binder et al. | |
| 2006/0053567 | A1 | 3/2006 | Sandbach et al. | |
| 2006/0073994 | A1 | 4/2006 | Hage et al. | |
| 2006/0105937 | A1 | 5/2006 | Duran et al. | |
| 2006/0183656 | A1 | 8/2006 | Bastigkeit et al. | |
| 2006/0205627 | A1 | 9/2006 | Ouwendijk-Vrijenhoek et al. | |
| 2006/0245816 | A1 | 11/2006 | Sharp et al. | |

FOREIGN PATENT DOCUMENTS

| | | | |
|---|---|---|---|
| DE | 195 36 714 | A1 | 4/1997 |
| EP | 0063668 | | 4/1981 |
| EP | 0218371 | A1 | 9/1985 |
| EP | 1 714 605 | A1 | 10/2006 |
| EP | 1 714 712 | A1 | 10/2006 |
| FR | 2561097 | | 3/1984 |
| GB | 971691 | A | 9/1964 |
| JP | 7100288 | | 4/1995 |
| JP | 2001149692 | | 11/1999 |
| WO | WO 97/20099 | | 6/1997 |
| WO | WO 99/02769 | | 1/1999 |
| WO | WO 99/04082 | | 1/1999 |
| WO | WO 99/46319 | | 9/1999 |
| WO | WO 01/04260 | A1 | 1/2001 |
| WO | WO 01/04407 | A2 | 1/2001 |
| WO | WO 01/04407 | A3 | 1/2001 |
| WO | WO 02/079362 | A2 | 10/2002 |
| WO | WO 02/079363 | A2 | 10/2002 |
| WO | WO 02/079366 | A1 | 10/2002 |
| WO | WO 02/079367 | A1 | 10/2002 |
| WO | WO 02/079368 | A1 | 10/2002 |
| WO | WO 02/079369 | A1 | 10/2002 |
| WO | WO02/079370 | A | 10/2002 |
| WO | WO 2006/055713 | A1 | 5/2006 |

* cited by examiner

FIG. 9
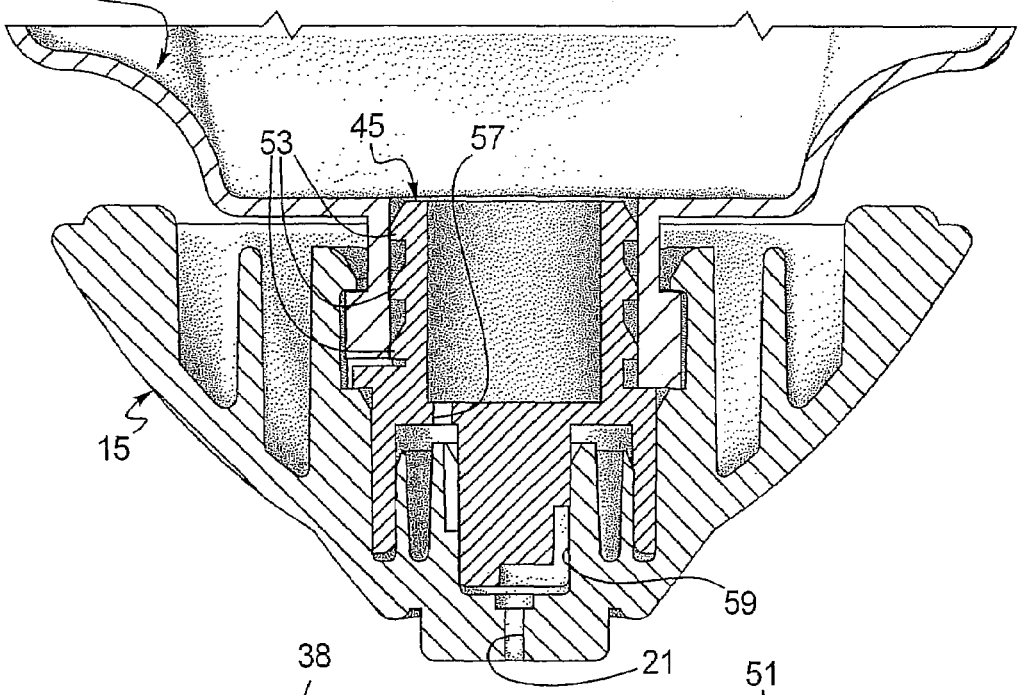
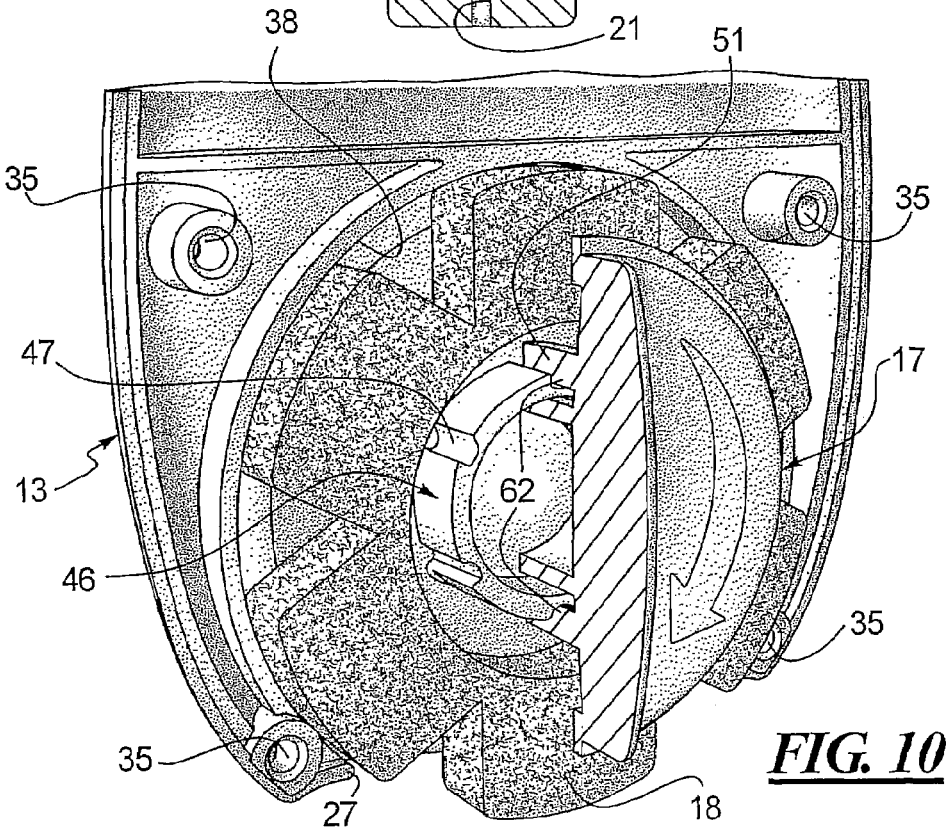
FIG. 10

INSTANT STAIN REMOVING DEVICE, FORMULATION AND ABSORBENT MEANS

CROSS-REFERENCE TO RELATED APPLICATION

This application is based on and claims priority from provisional patent Application No. 60/805,159, filed on Jun. 19, 2006.

BACKGROUND

1. Technical Field

An instant stain removing device is disclosed which comprises a compact structure provided with an applicator tip for dispensing an instant stain removing formulation. The device includes a reservoir with the applicator tip disposed at one end of the reservoir. The reservoir is preferably connected to an absorbent pad dispenser. When a person notices a stain or a spot on an article of clothing he/she is wearing, the user applies stain removing formulation through the applicator tip to treat the stain. Then, the user rotates the device and applies one of the absorbent pads against the moistened area to absorb, lift and/or remove the stain, excess stain removing formulation, and to lessen visibility of the moistened area as well as reduce the time needed for the moistened area to dry. Effective formulations for instantly removing stains and spots from articles of clothing or which render such stains and spots invisible or less visible are also disclosed.

2. Description of the Related Art

It is highly embarrassing to spill dark-colored liquid or food on a light-colored garment when one is at work or otherwise away from home. The same is true for accidentally marking one's clothes with a pen or marker. Such occurrences are especially embarrassing when it happens early in the day, or when business or social meetings are scheduled before one has time to change clothes. In response to the obvious consumer need for a device and a formulation for treating stains, spills or markings on clothing while "on-the-go," instant stain removing pens, wipes, pledgets, aerosols, swabs and other devices have been developed.

One particular device developed by Procter & Gamble is the TIDE-TO-GO product which resembles a large felt tip marker in structure but which includes an applicator tip or nib the dispenses a clear stain-removing formula from a reservoir. The European version of this product is sold under the trademark ARIEL POCKET. Various aspects of the product are disclosed in U.S. Pat. Nos. 6,832,867, 6,838,423, 6,846,332 and 6,644,879. While this and other similar products are suitable to be used directly on clothing that is being worn, one problem associated with these products it is that the user must walk around with a visible wet spot on his/her clothing that can be just as embarrassing as the original food, drink or ink stain.

Another problem associated with the above-referenced devices is the lack of ability to effectively remove or lift a stain from the fabric. Devices that merely apply a stain removing formulation to the stain may "dilute" or "spread" the stain as opposed to removing or lifting the stain. While the stain may be lighter than it was before treatment, the stain remains clearly visible and therefore, embarrassing.

In an attempt to address the stain diluting or stain spreading issues as well is the residual wet spot issue, attempts have been made providing some sort of absorbent or drying mechanism to devices used for spot-cleaning of fabric and clothing. U.S. Pat. Nos. 6,829,913, 6,883,353 and U.S. Published Application Nos. 2002/0178507 and 2002/0183225, all assigned to Unilever, disclose devices for applying spot cleaning fluid through one end of a device that also includes an absorbent mechanism disposed at the other end of the device. However, these devices fail to combine an effective formula, an effective and efficient applicator tip and an effective absorbent pad mechanism. While one embodiment disclosed in the Unilever references discloses discrete absorbent pads that may be used, broken off and discarded after they become discolored, the mechanism for advancing the pads out the end of the pad holder is awkward and non-ergonomic. Also, the length or overall size of these types of devices is problematic.

U.S. Pat. No. 6,715,326 and French Publication No. 2561097 both disclose single-use spot removing devices that include linearly aligned chambers, one chamber for the stain removing fluid and another chamber for an absorbent pad. The '326 patent discloses a first chamber containing a spot removing fluid and that is equipped with a twist-off frangible closure element. The second chamber of the '326 patent is oppositely directed but axially aligned with the first chamber and accommodates a cylindrical absorbent pad that extends out an open end of the second chamber. After the twist-off closure element is removed from the first chamber and the liquid spot remover has been discharged onto the stain, the excess fluid may be absorbed by the pad as the pad is rubbed against the stain. The French publication discloses a frangible first chamber with cleaning fluid and a coaxial cylindrical absorbent pad for working the fluid into the stain and absorbing excess fluid.

Motorized stain removal brushes are also known in the art (see e.g. U.S. Published Application Nos. 2004/0084063, 2005/0066996 and 2005/0199265), but these devices are obviously bulky to carry around, require batteries and are more difficult to use. Along the same lines are hand-held ultrasonic applicators for treating stains are disclosed in U.S. Pat. Nos. 6,376,444, 6,391,061, 6,589,294, 6,624,133 and 6,689,730. These devices are also not practical for on-the-go stain or spot removal needs.

Other self-contained on-the-go stain removing devices with a pen-type structure are shown in U.S. Pat. Nos. 5,765,407, 5,993,097, 6,074,705, U.S. Published Application No. 2003/0145634 and French Patent No. 2,561,097. These devices also fail to combine an effective formula, an effective applicator tip and an effective means for absorbing or drying excess stain removing fluid.

Another issue not solved by the above solutions is how to treat difficult-to-remove stains. Because an on-the-go stain removing device utilizes a fluid that will often come in contact with the user's skin and further because such a stain removing devices will be used on delicate fabrics, there is a limit to the strength of an oxidant or bleach the can be used for removing difficult stains such as blood and ink. Typically, halogens and higher concentrations of peroxides have been avoided because of their ability to irritate human skin or damage or discolor delicate fabrics.

Therefore, there is a need for an on-the-go stain removing device that provides an effective formulation for removing or decolorizing common everyday stains from articles of clothing. Further, there is a need for an improved on-the-go stain removing device that provides a means for reducing the dry time for the formulation so that the user does not have to wear clothing with a visible wet spot thereon for a prolonged period of time. Still further, there is a need for an improved on-the-go stain removing device with a means for lifting and removing the treated stain or material constituting the stain from the treated fabric. Finally, an ergonomic, compact device is needed.

SUMMARY OF THE DISCLOSURE

In satisfaction of the aforenoted needs, an improved applicator for applying stain treatment fluid to fabric, such as clothing that is being worn, is disclosed. The disclosed applicator comprises a fluid reservoir in communication with an applicator valve assembly. Preferably, the device also includes a shell connected to the reservoir for housing absorbent material. The fluid reservoir contains a stain treatment formulation.

In a refinement, the shell comprises an opening through which an absorbent material may extend to absorb, wick or lift excess fluid and stain material from the fabric or clothing thereby reducing the drying time for the resulting wet spot and providing improved stain removal function.

In another refinement, the absorbent material is provided in the form a plurality of pads mounted on a frame that can rotate within the shell permitting the exposure of one pad at a time through the opening in the shell. Rotation of the frame results in the exposure of a fresh pad through the opening in the shell.

In another refinement, the absorbent material is provided in the form a ring or disk that rotates within the shell permitting the exposure of part of the material at any given time through the opening in the shell. Rotation of the ring or disk results in the exposure of a fresh absorbent material.

Other means for providing fresh absorbent pads includes a stack of pads that emerge from an opening in the housing or a pad structure whereby a soiled or wet portion of the pad structure can be separated and removed.

In a refinement, the absorbent pad comprises matted fibers or fibers having a random or non-discernible orientation. In a related refinement, the pads comprise polyester felt material.

In a refinement, discreet pads are mounted onto a ring shaped frame.

In a refinement, the pads are integral with a ring shaped frame.

In any of the embodiments, the absorbent pads may be covered with a protective cap or cover, either completely removable or hinged to the shell.

In yet another refinement, the structure of the device may be easily disassembled so that fresh absorbent pads may be installed and/or the reservoir refilled with stain treatment fluid and/or a new reservoir of stain treatment fluid can be installed.

In another refinement, the reservoir body is translucent or see-through so that the user can easily determine the amount of stain treatment fluid remaining in the reservoir.

In another refinement, the applicator valve assembly comprises a restrictive flow element that provides communication between the fluid reservoir and a throttle element. The throttle element comprising an exit orifice and movement of the throttle and restrictive flow elements relative to each other control flow between the reservoir and exit orifice.

In a refinement, rotation of the throttle element with respect to the restrictive flow element permits or prevents flow through the restrictive flow element. In yet another related refinement, the throttle element rotates between an "off" position where fluid communication between the reservoir and orifice is prevented and an "on" position where fluid communication from the reservoir to the exit orifice is established.

In a different refinement, axial movement of the throttle element with respect to the restrictive flow element permits or prevents flow through the restrictive flow element. In a related refinement, the throttle element moves axially towards the restrictive flow element and into an "off" position where fluid communication between the reservoir and orifice is prevented and axially away from the restrictive flow element to an "on" position where fluid communication from the reservoir to the exit orifice is established. In one variation, the valve assembly comprises a nozzle connected to the outlet of the reservoir. The nozzle accommodates a porous flow restrictor. An o-ring seal prevents fluid communication between the reservoir and the exit orifice of the throttle when the throttle is moved axially towards the reservoir. Movement of the throttle axially away from the reservoir releases the seal and permits communication from the reservoir, through the flow restrictor and nozzle and out the exit orifice of the throttle.

In a refinement, the restrictive flow element comprises a restrictive flow conduit in communication with the reservoir and wherein a diameter of the conduit ranges from about 0.010 to about 0.060 inches.

In another refinement, the restrictive flow element is mateably received within an open end of the fluid reservoir. In a related refinement, the restrictive flow element is also mateably received within the throttle element. In such a refinement, the open end of the reservoir is disposed opposite the reservoir from the shell that houses the absorbent material.

In a refinement, the reservoir and absorbent material shell, in combination, are ergonomically shaped.

In another refinement, the shell comprises a knob that engages the absorbent material. The knob comprising an outwardly protruding lip to facilitate rotation of the knob and absorbent material. In a related refinement, the note the structure includes a downwardly extending cylindrical wall that is frictionally and mateably received within the pad ring so that rotation of the knob results in rotation of the pad ring.

In another refinement, the pads are detachable from a frame or disk and may be discarded when they become used or discolored. As one alternative, the pads remain on the disk or frame and are rotated back into the shell after they are used or become discolored.

In another refinement, the absorbent pads may be ejected from the opening of the shell or pulled off by a sidewall of opening of the shell when the ring shaped frame or disk is rotated.

Methods for treating stains on articles of clothing while the clothing is being worn are also disclosed. Such methods comprise using one of the devices disclosed above to treat a stain, mark or spot and using the absorbent means or pad associated with the device to at least partially lift or remove the stain and absorb or wick excess stain removing formulation from the clothing thereby reducing the dry time of the formulation or causing the wet spot associated with the formulation to dry faster.

More specifically, one improved method for treating stains or spills on fabrics, such as articles of clothing, is disclosed which comprises optionally removing excess material from the fabric, applying a stain treatment fluid to the stain or spill using one of the devices described herein, using one of the absorbent pads described herein to work in the stain treatment fluid into the stain or spill thereby treating the stain or spill, and using either the same pad or a new pad to absorb excess fluid to reduce drying time.

In another refinement, a dual-reservoir device may be provided that includes two different stain-removing formulations, one for everyday stains and one for more problematic stains such as ink and grease. Such a dual-reservoir device may be provided with dual valve assemblies.

The stain treatment fluid can comprise water, at least one anionic surfactant and at least one nonionic surfactant.

In a refinement, the stain treatment fluid comprises a bleach. In a further refinement of this concept, the bleach is hydrogen peroxide.

In another refinement, the at least one anionic surfactant comprises isopropylamine sulfonate.

In another refinement, the at least one anionic surfactant comprises a sodium alkyl sulfonate. In a further refinement of this concept, the at least one anionic surfactant comprises sodium capryl sulfonate.

In another refinement, the at least one anionic surfactant is selected from the group consisting of sodium lauryl sulfate, isopropyl amine sulfonate, linear ethoxylated alcohols, sodium capryl sulfonate and mixtures thereof. Preferably, the anionic surfactants are provided in the form of a combination of sodium lauryl sulfate, isopropyl amine sulfonate, at least one linear ethoxylated alcohol and sodium capryl sulfonate.

In a related refinement, suitable anionic surfactants may be selected from the group consisting of alkyl sulfates, alkyl ethoxy sulfates (AES) such as NaAES and $NH_4$AES, amine oxides, and mixtures thereof. The alkyl sulfate surfactants may include branched-chain and random $C_{10}$-$C_{20}$ alkyl sulfates, and $C_{10}$-$C_{18}$ secondary (2,3) alkyl sulfates of the formula $CH_3(CH_2)_x(CHOSO_3M^+)CH_3$ and $CH_3(CH_2)_y(CHOSO_3M^+)CH_2CH_3$ where x and (y+1) integers of at least 7, preferably at least 9, and M is a water-solubilizing cation, especially sodium, as well as unsaturated sulfates such as oleyl sulfate. Alkyl ethoxy sulfate (AES) surfactants used herein are conventionally depicted as having the formula $R(EO)_xSO_3Z$, wherein R is $C_{10}$-$C_{16}$ alkyl, $(EO)_x$ is $(CH_2CH_2O)_x$, x is 1-10 and can include mixtures which are conventionally reported as averages, e.g., $(EO)_{2.5}$, $(EO)_{6.5}$ and the like, and Z is a cation such as sodium ammonium or magnesium (MgAES). The $C_{12}$-$C_{16}$ alkyl dimethyl amine oxide surfactants can also be used.

In another refinement, the least one nonionic surfactant is an ethoxylated alcohol. In a related refinement, the ethoxylated alcohol is represented by the formula $CH_3(CH_2)_mO(CH_2CH_2O)_nH$, wherein m+n ranges from about 10 to about 17, more preferably from about 12 to about 15.

In another refinement, the nonionic surfactant comprises a linear ethoxylated $C_{12-15}$ alcohol.

In yet another refinement, the nonionic surfactant comprises a combination of O—X—O alcohol ethoxylate and a linear ethoxylated $C_{12-15}$ alcohol.

In another refinement, the level of nonionic surfactant is maintained below 2 wt % to minimize the formation of residue on the fabric or article of clothing.

Suitable nonionic surfactants with a satisfactory HLB (hydrophilic-lipophilic balance) value in the range of 9-17 include but are not limited to: the ethoxylated octylphenols; ethoxylated fatty alcohols, including the ethoxylated primary fatty alcohols; ethoxylated secondary fatty alcohols; ethoxylated nonylphenols; ethoxylated sorbitan fatty acid esters, and sorbitan fatty acid esters.

In a refinement wherein the stain treatment fluid comprises a bleach, a preferred bleach is hydrogen peroxide (~35% solution) in an amount ranging from about 1 to about 4 wt % of the final formulation.

In a refinement, the stain treatment fluid further comprises a preservative.

In a refinement, the stain treatment fluid further comprises a co-solvent such as an alcohol.

In another refinement, the stain treatment fluid further comprises an acid.

In another refinement, the formulation includes one or more chelating agents. Suitable chelating agents include but are not limited to: lactic acid; the salts of ethylenediamine tetraacetic acid (EDTA), such as ethylenediamine tetraacetic acid disodium salt, ethylenediamine tetraacetic acid diammonium salt, ethylenediamine tetraacetic acid trisodium salt, ethylenediamine tetraacetic acid tetrasodium salt, ethylenediamine tetraacetic acid tetrapotassium salt, ethylenediamine tetraacetic acid tetrammonium salt and the like; the salts of diethylenetriaminepentaacetic acid (DTPA), such as diethylenetriaminepentaacetic acid pentapotassium salt and the like; the salts of (N-hydroxyethyl) ethylenediaminetriacetic acid (HEDTA), such as (N-hydroxyethyl) ethylenediaminetriacetic acid trisodium salt, (N-hydroxyethyl) ethylene-diaminetriacetic acid tripotassium salt and the like; the salts of nitrilotriacetic acid (NTA), such as nitrilotriacetic acid trisodium salt, nitrilotriacetic acid tripotassium salt and the like; other chelating agents such as triethanolamine, diethanolamine, monoethanolamine and the like, and mixtures thereof. However, because of its low cost and effectiveness, the preferred chelating agent is citric acid.

In another refinement, the acid is added to lower the pH of the formulation and, preferably, the acid is citric acid.

One preferred formulation comprises water in an amount ranging from about 95 to about 99.5 wt %, sodium capryl sulfonate in an amount ranging from about 0 to about 0.5 wt %, isopropylamine sulfonate in an amount ranging from about 0 to about 0.50 wt %, a $C_{12}$-$C_{15}$ ethoxylated alcohol in an amount ranging from about 0 to about 0.50 wt %, at least one preservative and, optionally, hydrogen peroxide (~35%) in an amount ranging from about 0 to about 4 wt %.

In another refinement, two different aqueous formulations are provided including one for everyday stains that does not include a bleach, such as hydrogen peroxide. For example, a two-piece device may be provided which includes separable structures, each structure may include a reservoir and an applicator tip. One reservoir may include an aqueous formulation for everyday stains that comprises a nonionic surfactant, an anionic surfactant, a solvent, a chelating agent and optional ingredients such as a preservative and fragrance. An aqueous formulation for blood, ink and greasy foods may be provided in the other reservoir and comprise a nonionic surfactant, an anionic surfactant, one or more solvents, a chelating agent, a bleach (preferably hydrogen peroxide) and optional ingredients such as a preservative and fragrance. The formulations may include combinations of many of the ingredients such as combinations of nonionic surfactants, anionic surfactants, solvents, chelating agents, preservatives and fragrances.

As an alternative to the valve assemblies discussed above, check valves, duckbill valves, flapper valves, cross-slot diaphragm valves, etc., may also be employed. Further, another option for the applicator tip may be a porous plastic material or porous foam. In yet another refinement, the restrictive flow element may simply comprise one or more restrictive flow tubes, conduits or channels the provide communication between the fluid reservoir and the exit orifice. In such an embodiment, a cap or cover would be needed.

Other advantages and features will be apparent from the following detailed description when read in conjunction with the attached drawings. It will also be noted here and elsewhere that the devices disclosed herein can be used to apply fluids other than stain treatment fluids.

BRIEF DESCRIPTION OF THE DRAWINGS

For a more complete understanding of the disclosed methods and apparatuses, reference should be made to the embodiments illustrated in greater detail in the accompanying drawings, wherein:

FIG. 9 is another partial sectional view the valve assembly shown in FIG. 8, particularly illustrating the valve assembly in an "off" or closed position;

FIG. 10 is a partially sectional view illustrating the ring of absorbent pads, shell and actuator for the device shown in FIGS. 1-9 and 12-13;

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein and further that the devices disclosed herein can be used to apply fluids other than stain treatment fluids.

DETAILED DESCRIPTION OF THE PRESENTLY PREFERRED EMBODIMENTS

Figure 11:
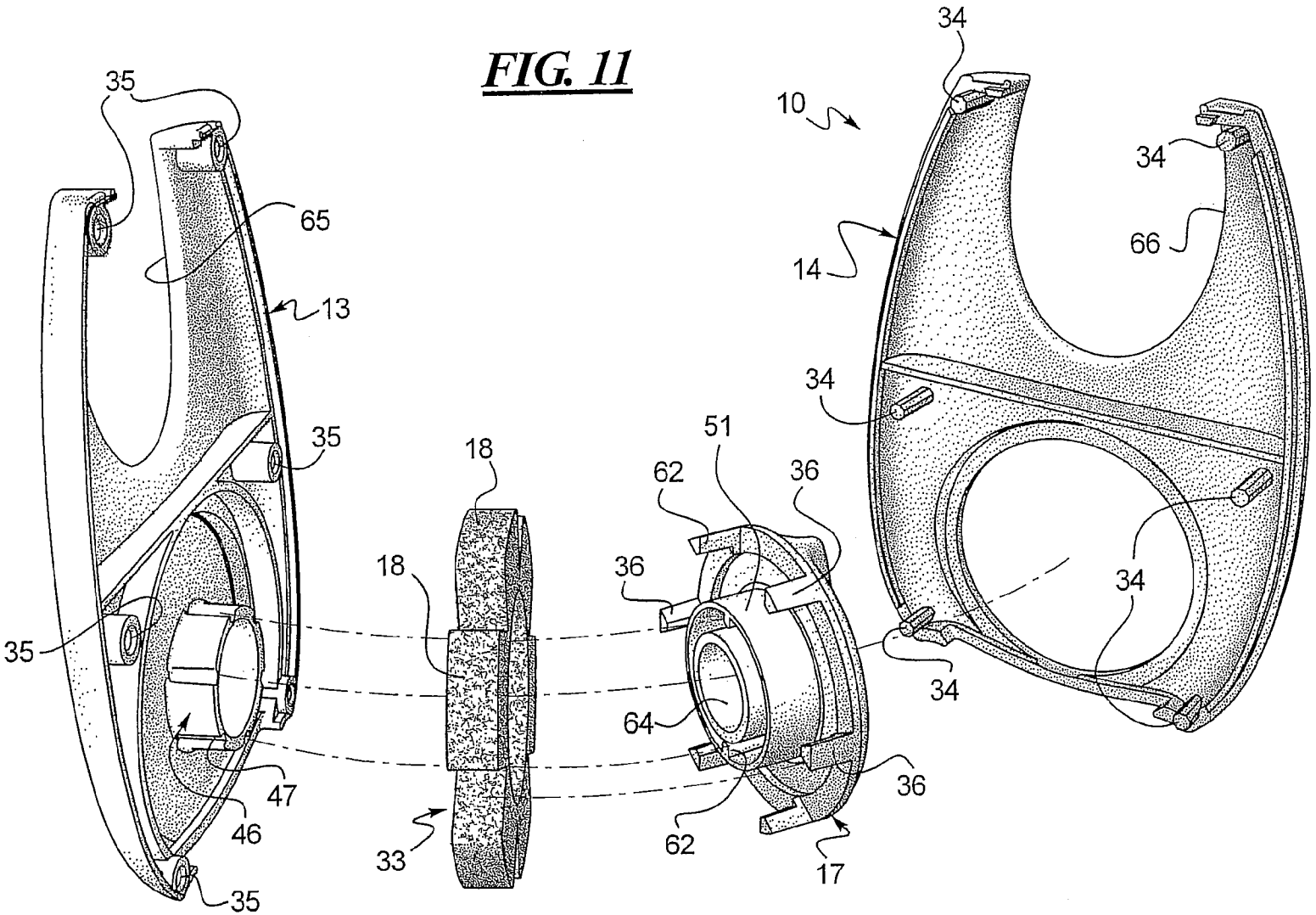
FIG. 11 is an exploded view illustrating the ring of absorbent pads, shell and actuator for the device shown in FIGS. 1-10 and 12-13.
Figure 12:
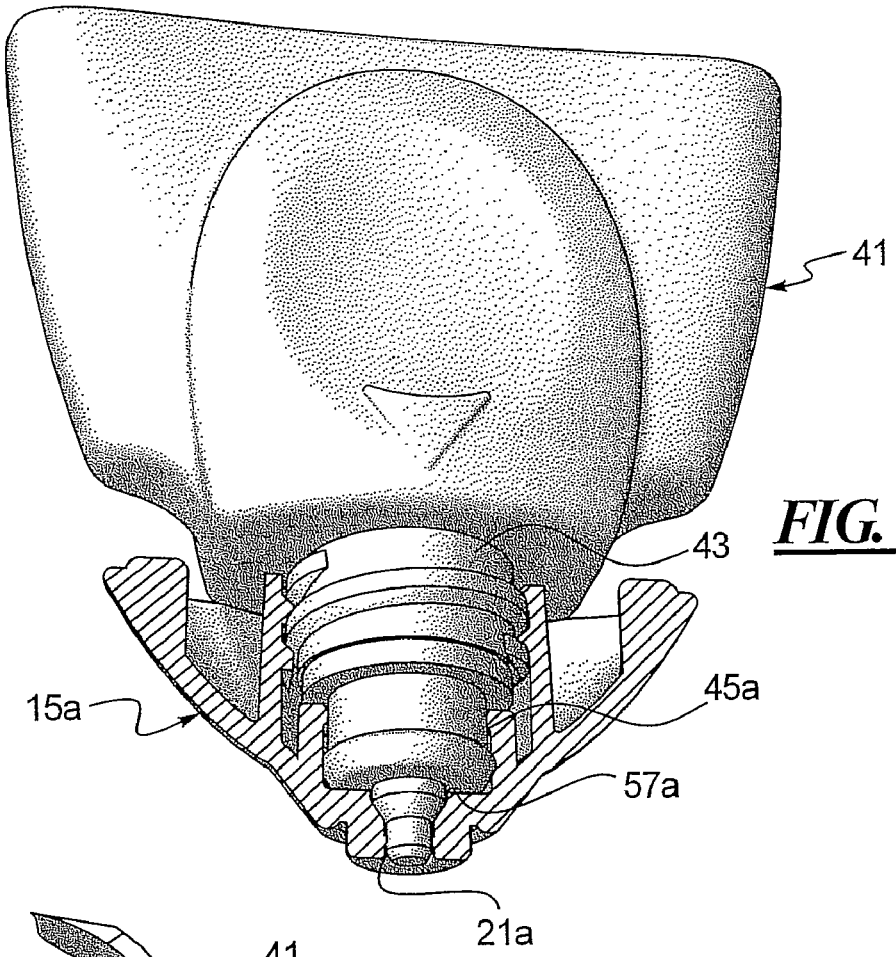
FIG. 12 is a partial sectional view of another valve assembly made in accordance with this disclosure, particularly illustrating the valve assembly in an "off" or closed position.
Figure 13:
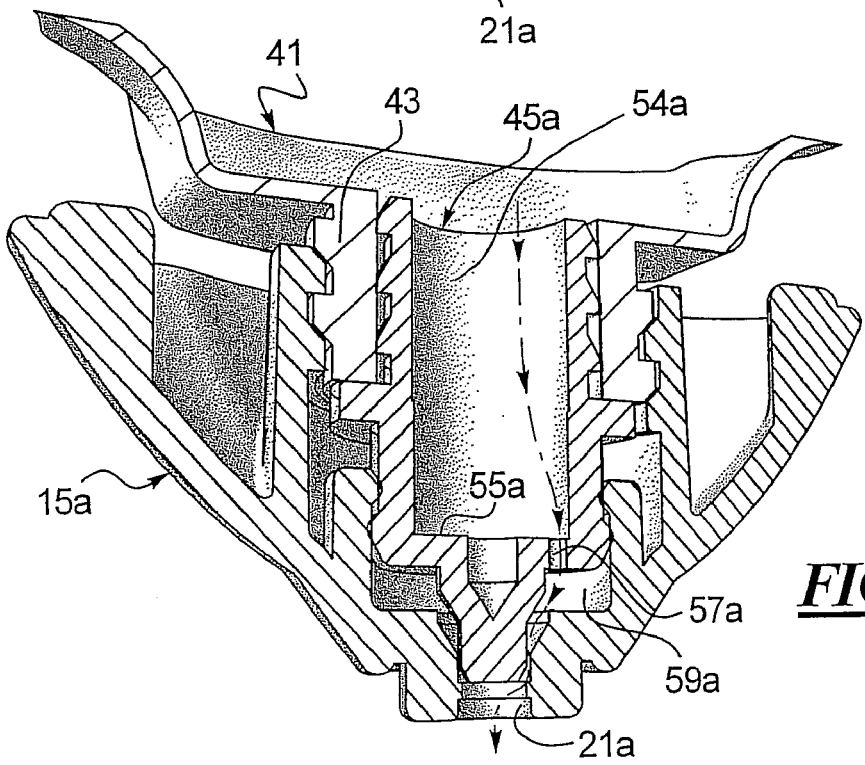
FIG. 13 is another partial sectional view of the valve assembly shown in FIG. 12, particularly illustrating the valve assembly in an "on" or open position.
Figure 14:
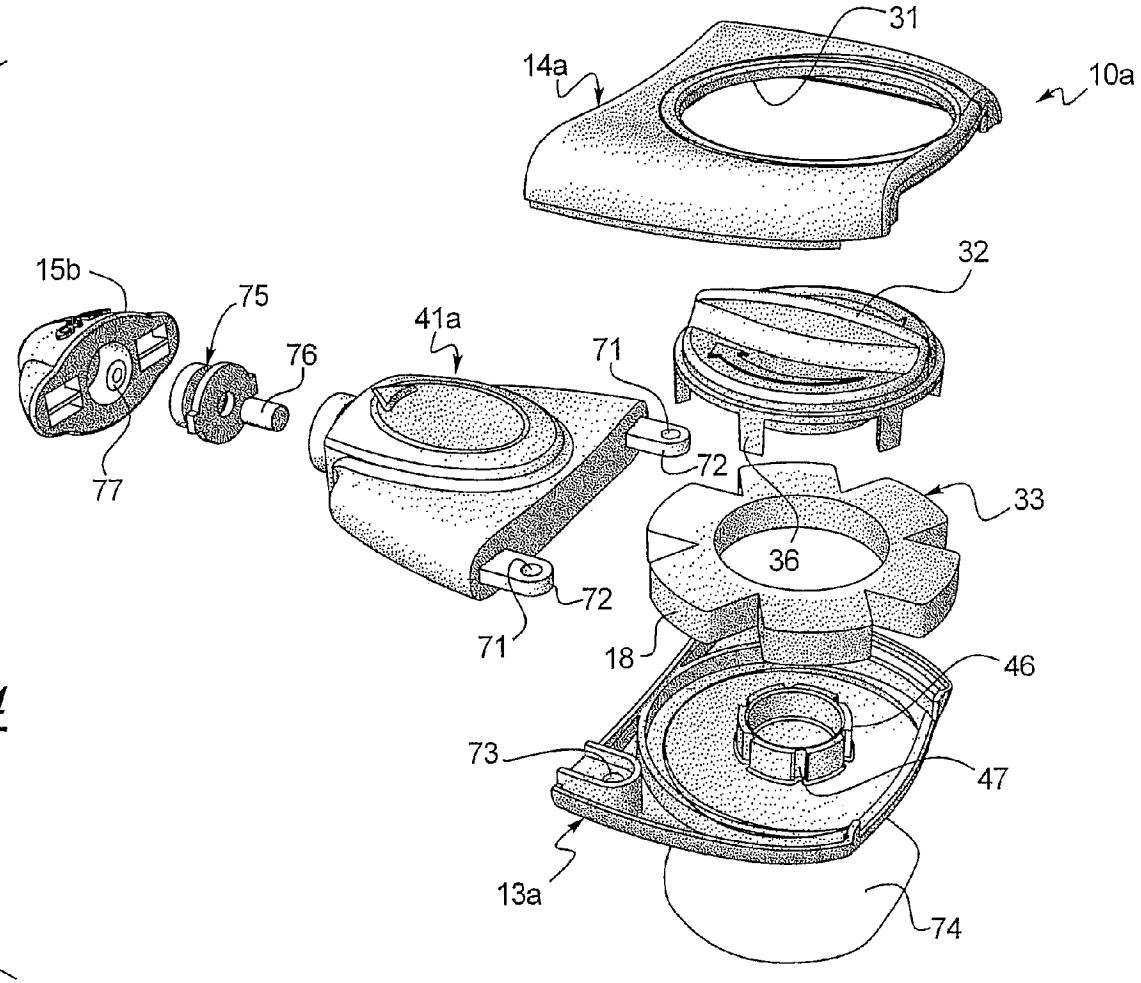
FIG. 14 is an exploded view of an alternative stain treatment device.
Figure 15:
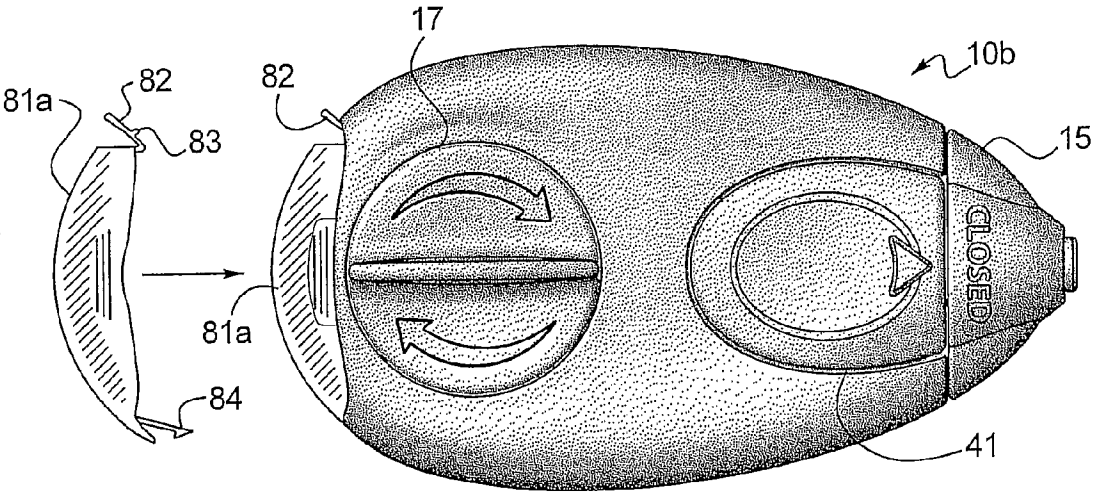
FIG. 15 is a plan and partial exploded view of yet another stain treatment device that includes a cap or cover for the absorbent pads.
Figure 16:
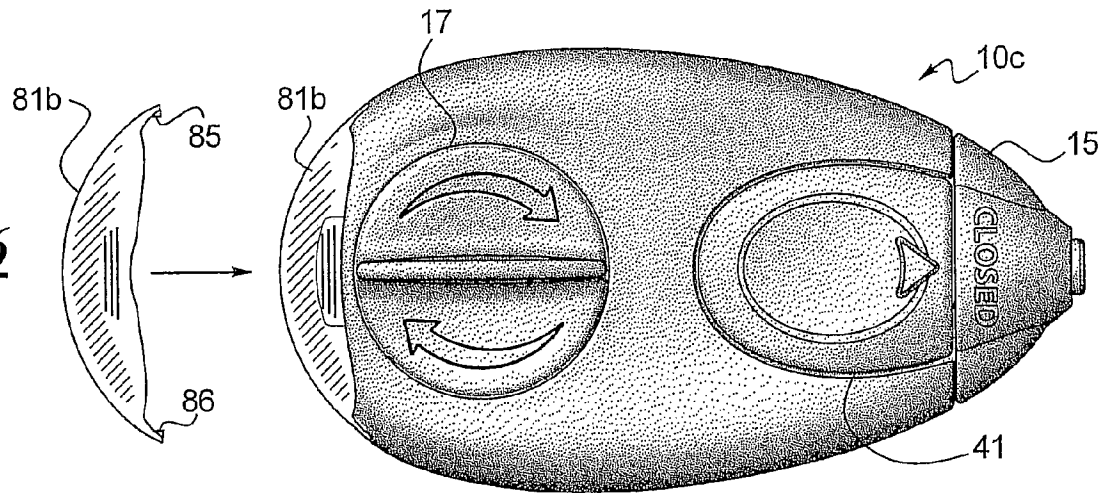
FIG. 16 is a plan and partial exploded view of yet another stain treatment device that includes a cap or cover for the absorbent pads.

An exemplary applicator or device for applying a stain treatment formulation to fabric or an article of clothing is illustrated in FIGS. 1-13, with one type of valve assembly illustrated in FIGS. 4 and 6-9 and a second type of valve assembly illustrated in FIGS. 12-13. A third type of valve assembly and a structurally different embodiment is illustrated in FIG. 14 and two types of end caps or covers for the absorbent pads are illustrated in FIGS. 15-16.

Figure 1:
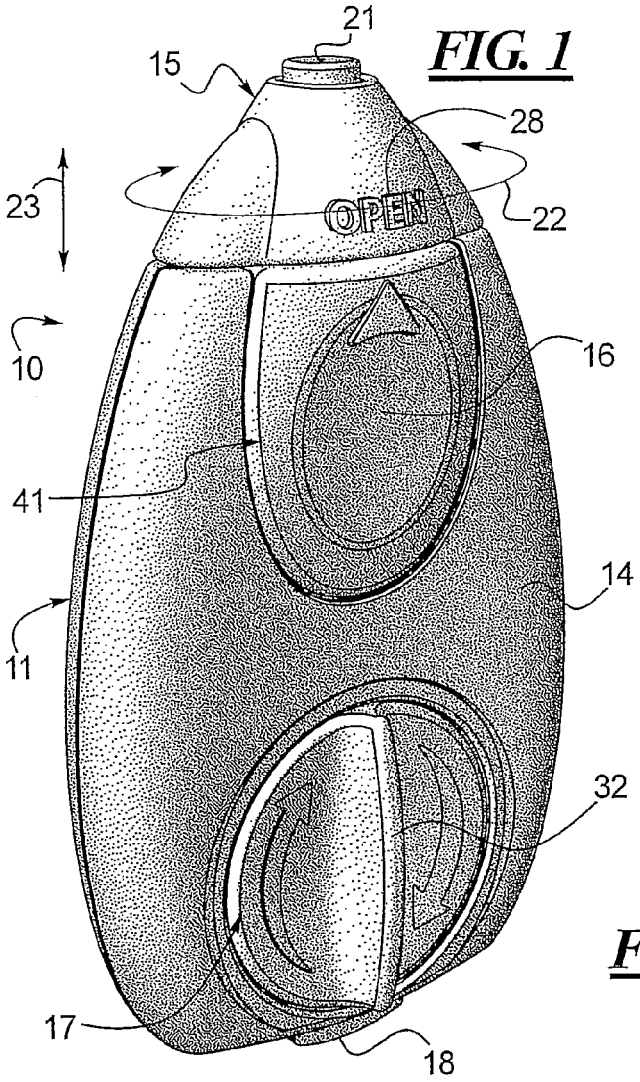
FIG. 1 is a front perspective view of an instant stain removing device equipped with an absorbent means in accordance with this disclosure.
Figure 3:
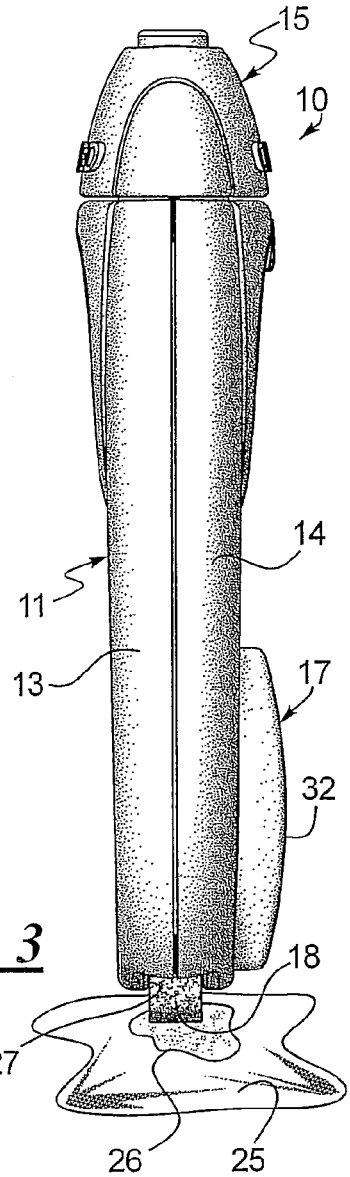
FIG. 3 is a side plan view of the device shown in FIGS. 1 and 2.
Figure 2:
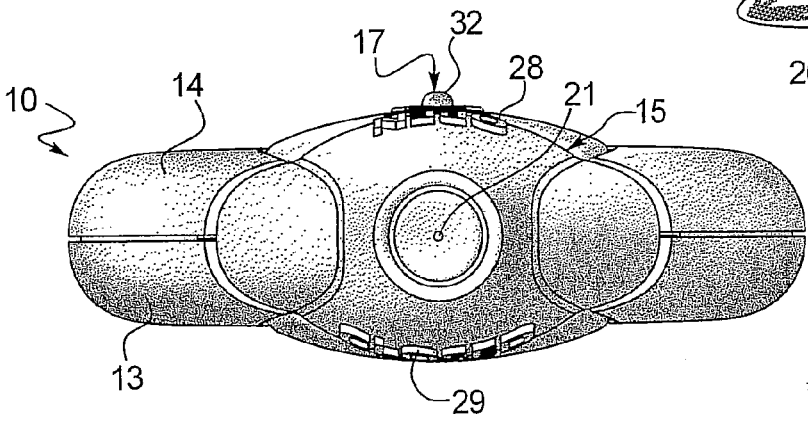
FIG. 2 is a top plan view of the device shown in FIG. 1.
Figure 4:
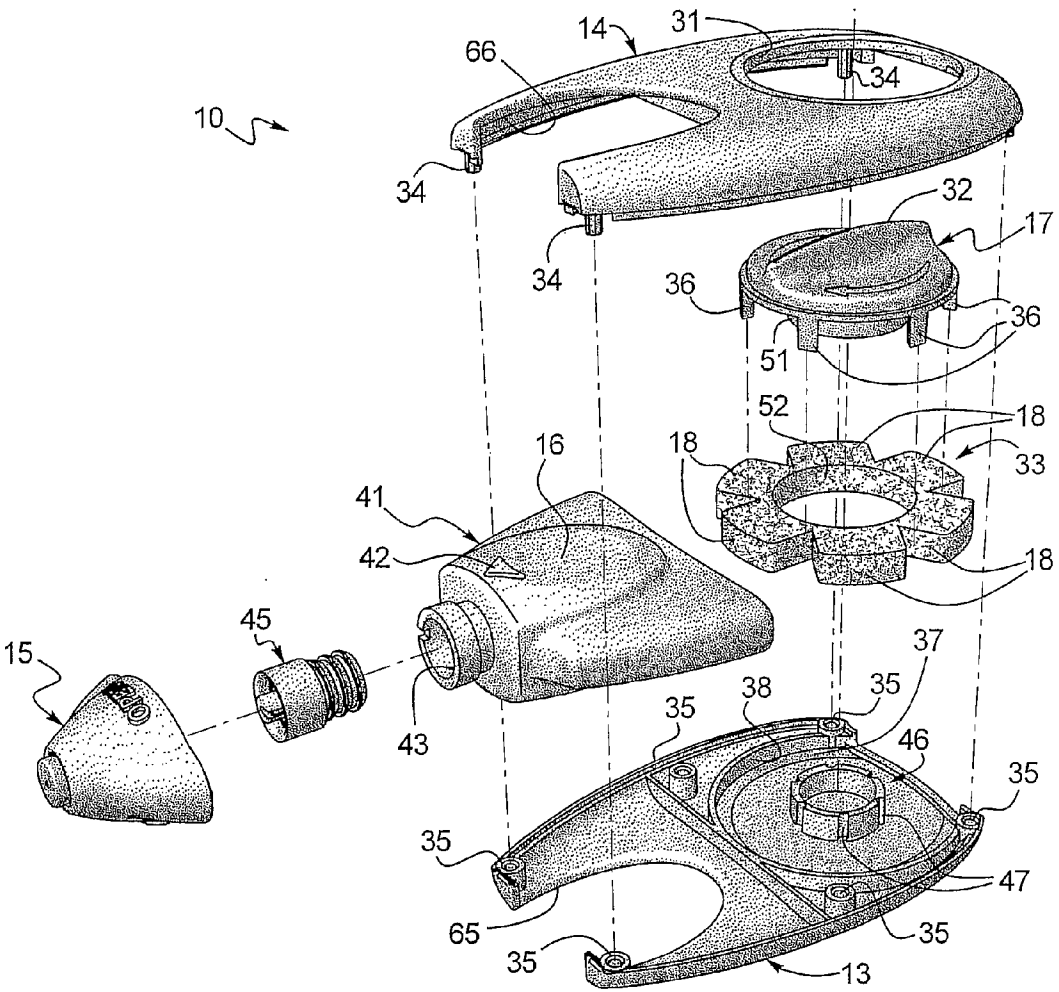
FIG. 4 is an exploded view of the device shown in FIGS. 1-3.

Turning first to FIG. 1, the applicator device 10 includes an outer housing 11 that, as shown in FIGS. 2-4, comprises two molded and mating halves or half-shells 13, 14. It may be desirable to detachably connected the half-shells 13, 14 together to replace the fluid reservoir 41 and/or absorbent pads 33 as discussed below in connection with FIG. 4. Returning to FIG. 1, the applicator 10 also includes a throttle element 15 which forms part of a valve assembly described below, a flexible wall 16 of the reservoir 41 for delivering stain treatment fluid, and an actuator 17 for delivering an absorbent pad 18 through an opening in the shell or housing 11.

As best seen in FIG. 2, the throttle element 15 includes an exit orifice 21 through which fluid is delivered when the valve assembly is moved to an open, on or dispense position as described below. As also described below, three types of valve assemblies are provided. The first type of valve assembly described in FIGS. 4 and 6-9 includes a throttle element 15 that rotates in either direction as indicated by the arrow 22 shown in FIG. 1. A second valve assembly provides a different throttle element design that requires axial movement of the throttle element as indicated by the arrow 23 shown in FIG. 1 and described below in connection with FIGS. 12-13. Another valve assembly that utilizes axial movement is described in FIG. 14.

In general, when a stain, mark or spill is to be treated, the throttle element 15 of the applicator 10 is opened and stain treatment fluid is delivered through the exit orifice 21 (FIGS. 1-2) to the clothing or fabric 25 to be treated (FIG. 3). Then, the applicator device 10 is rotated and the pad 18 is applied to the moistened area 26 to not only work the stain treatment fluid into the stain but also to absorb excess fluid and reduce the amount of the time required for the wet spot to dry. As seen in FIG. 3, the pad 18 extends outward through an open end or opening 27 in the housing or shell 11. As seen in FIG. 2, helpful indicia are provided at either side of the rotating-type throttle element 15. As seen in FIG. 1, the indicia 28 indicating that the throttle element 15 is in the open position is disposed along the same side as the flexible wall or pump 16 and actuator 17. The same configuration is shown in FIG. 2. As seen in FIG. 2, the closed indicia 29 is disposed on the opposite side of the housing 11 from the actuator 17 so as to not cause any confusion.

Turning to FIG. 4, the housing or shell includes a top portion 14 with an opening 31 for accommodating the actuator 17. The actuator 17 includes an upwardly protruding thumb or finger grip 32 to facilitate the rotation of the actuator 17 and the ring 33 of absorbent pads 18. The ring 33 of pads 18 maybe integrally formed as shown in FIG. 4 or may include a ring-shaped frame with separate pads 18 mounted thereon. The shell half 14 includes downwardly extending pegs 34 that mate with openings 35 on the lower shell half 13. The actuator 17 also includes downwardly extending pegs 36 that ride along in the track 37 formed in the lower shell half 13. The lower pegs 36 include a triangular-shaped cross-section and are accommodated between the pads 18 as shown by the phantom lines in FIG. 4. The ring 33 of pads 18 fits within the wall 38 of the lower shell half 13. A frictional/mateable engagement occurs between the cylinder 51 of the actuator 17 and the inner surface 52 of the absorbent pad ring 33.

The fluid reservoir is shown at 41 and includes a built-in pump 16 or flexible wall. The indicia 42 makes it clear to the user which direction the fluid will flow when the applicator 10 is moved to the open position. The reservoir 41 is fabricated from a flexible material and includes an open end 43 which receives a restrictive flow element 45 that, with the throttle element 15 forms a valve assembly. Preferably, the reservoir 41 is translucent or clear so the user is aware of how much stain treatment fluid remains in the reservoir 41.

The restrictive flow element 45 and throttle element 15 will be described in greater detail below in connection with FIGS. 6-10. Finally, in connection with FIG. 4, the cylindrical wall 46 disposed on the lower shell half 13 includes a plurality of recesses 47 that interact with the actuator 17 to provide a clicking sound to ensure the user that one of the pads 18 is centrally disposed within the opening 27.

Figure 5:
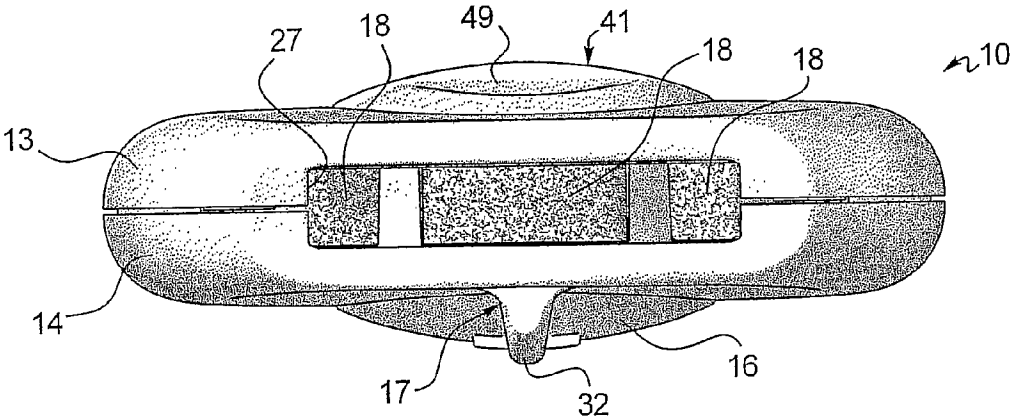
FIG. 5 is a bottom plan view of the device shown in FIGS. 1-4.

Turning to FIG. 5, a bottom view of the applicator 10 is shown whereby the actuator 17 has been rotated so that a single pad 18 is centrally located within the opening 27 formed by the lower and upper shell halves 13, 14 respectively. Also shown in FIG. 5 is a lower pumping element or flexible wall 49 to complement the action of the upper pumping element or flexible wall 16.

Figure 6:
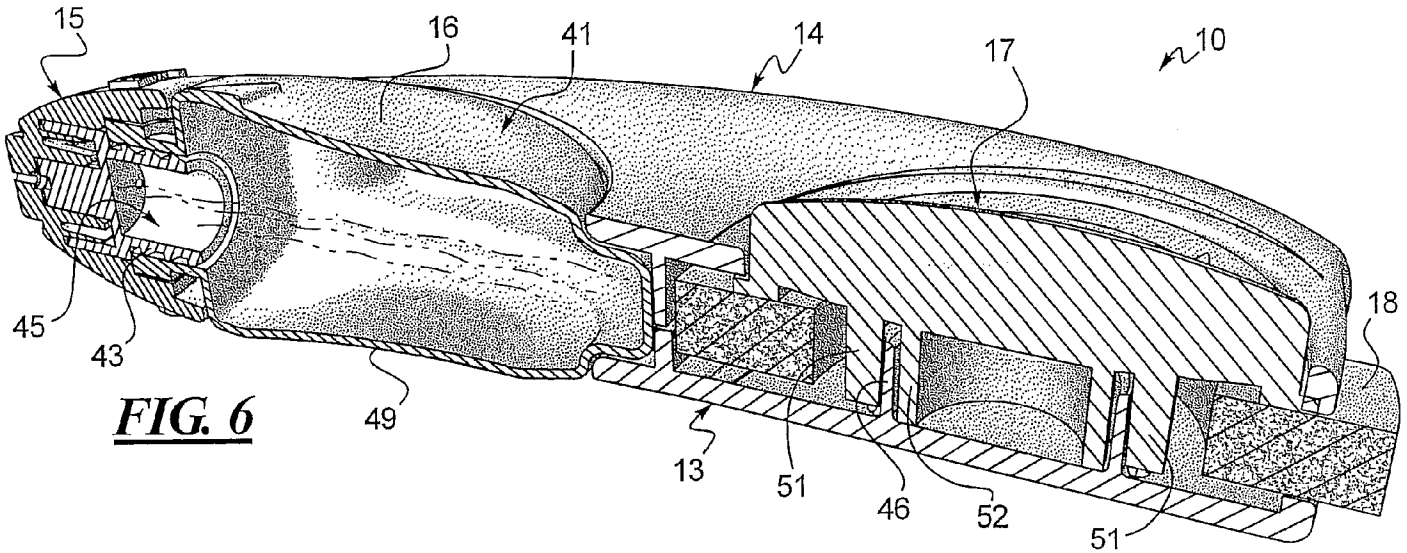
FIG. 6 is a perspective side sectional view of the valve assembly, reservoir and absorbent pad dispensing means shown in FIG. 4.

Still referring to FIG. 6, the downwardly extending pegs 36 of the actuator 17 frictionally engage the upwardly extending cylindrical wall 46 mounted on the lower shell half 13. The downwardly extending cylindrical wall 52 of the actuator 17 is received within the wall 46 of the shell half 13 as shown. Frictional engagement between the wall 51 and the recesses 47 of the wall 46 (See FIG. 4) provide an audible clicking sound or a sensation to the thumb or finger to signal to the user that the pad 18 is centrally located within the opening 27 as explained in greater detail below in connection with FIG. 11. The area of the housing 11 accommodating the pads 18 can be referred to as the shell and the reservoir 41 can also be a part of the housing 11 but, as shown in FIGS. 1-6, and 14, the reservoir 41 is a separate, flexible element that, like the absorbent pad ring 33, can be replaceable.

Figure 7:
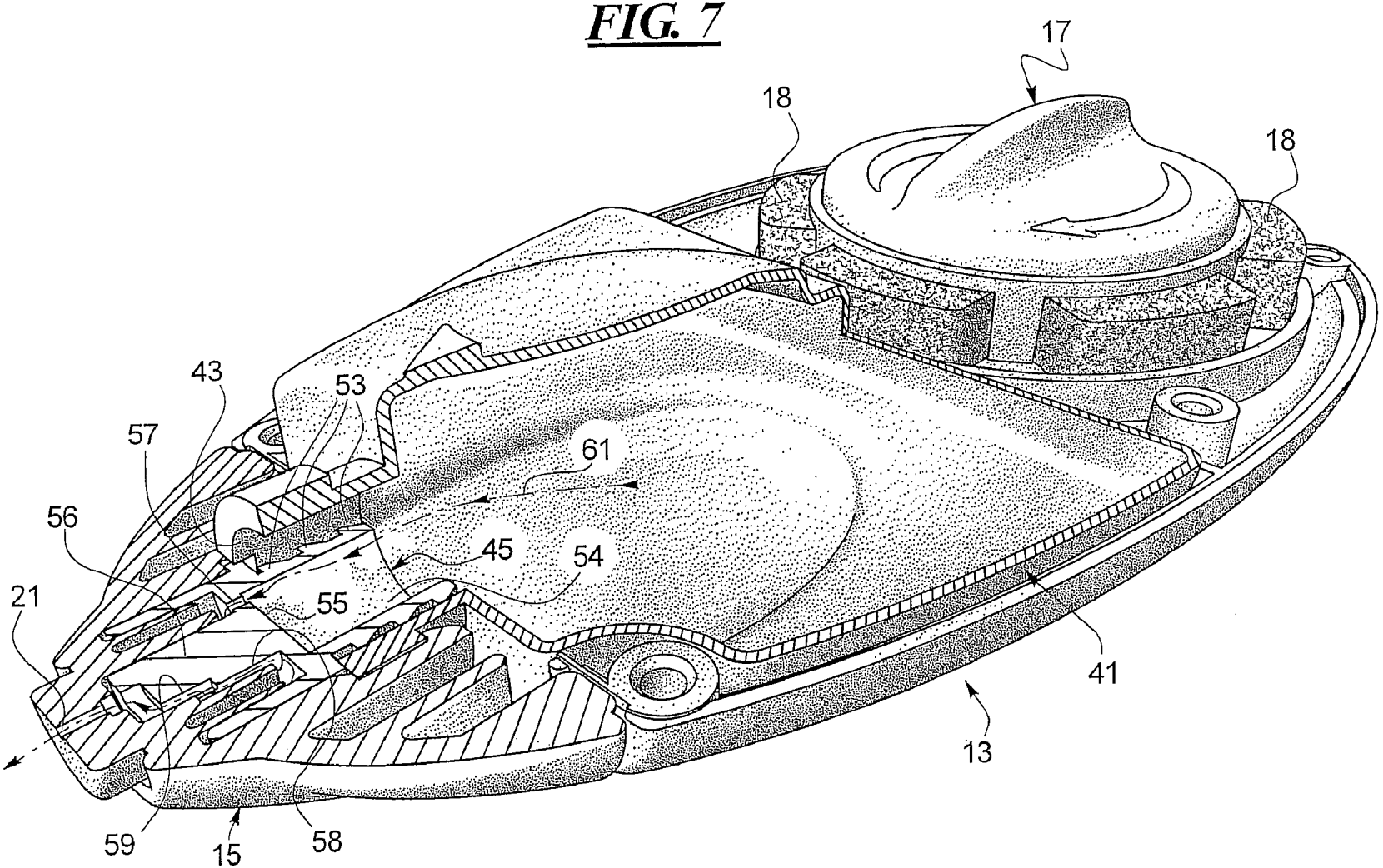
FIG. 7 is a another perspective sectional view of the device shown in FIG. 6.
Figure 8:
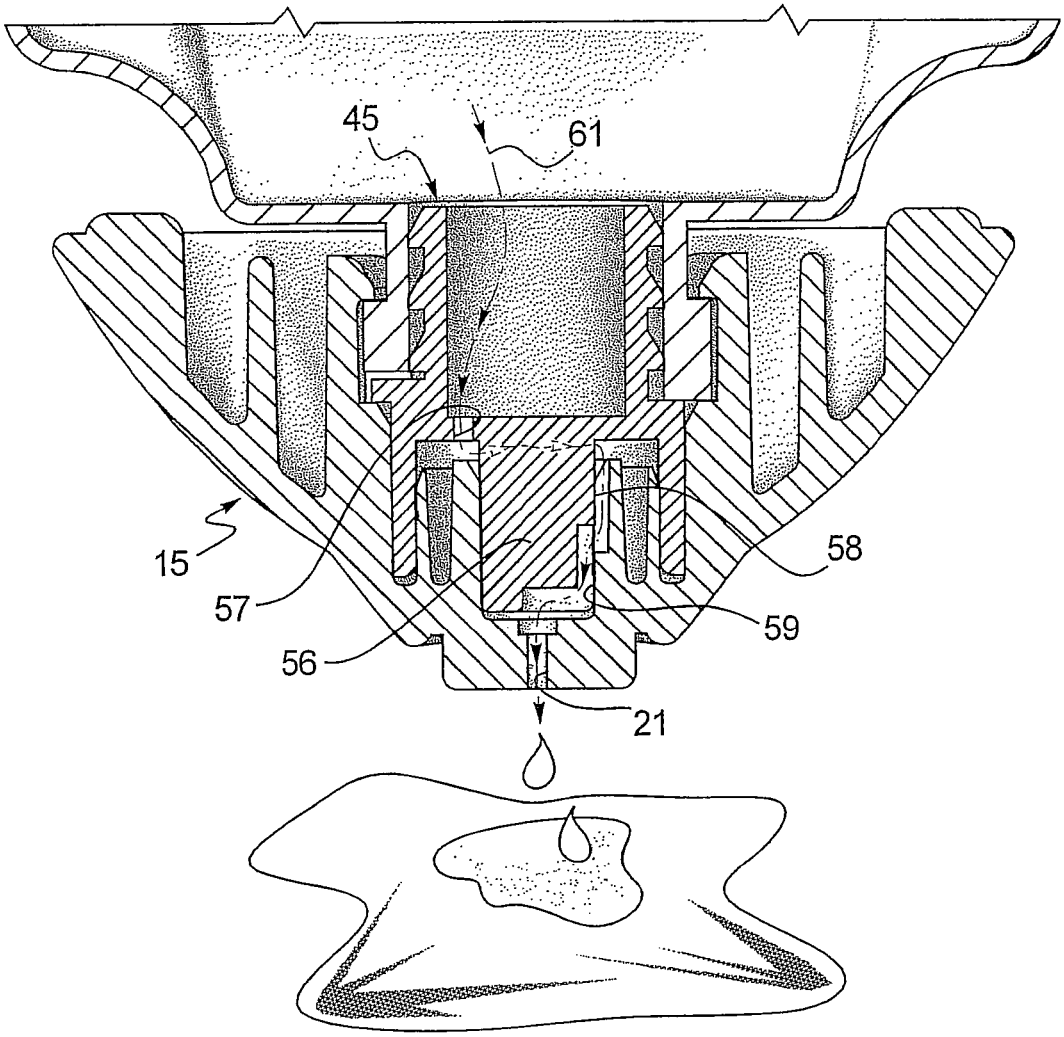
FIG. 8 is a partial sectional view of one embodiment of a valve assembly as shown in FIGS. 4 and 6-7, particularly illustrating the valve assembly in an "on" or open position.

FIG. 6 also illustrates a restrictive flow element 45 which is mateably received within the opening 43 of the reservoir 41. FIG. 6 also illustrates that the restrictive flow element 45 is mateably received within the throttle element 15. This relationship is illustrated in greater detail in FIGS. 7-9. Turning to FIG. 7, the restrictive flow element 45 is mateably received within the opening 43 of the reservoir 41. The outer annular barbs or ridges 53 enhance this frictional engagement and provide a sealing function as well. The restrictive flow element 45 includes a cylindrical portion 54 that terminates at a wall 55 of a solid end 56 but which has a through hole shown at 57. When the throttle 15 has been rotated to the open position as shown in FIG. 8, communication is established between the through hole 57 and the channel 58 opposite the solid structure 56. Thus, referring to the flow path shown by the line 61 of FIGS. 7-8, when the throttle 15 is in the position shown in FIGS. 7 and 8, pressure applied to the reservoir 41 will result in fluid migrating along the path 61, through the through hole 57, through the channel 58, through the connecting channel 59 and out the exit orifice 21 of the throttle element 15. Thus, in the open position shown in FIGS. 7 and 8, communication between the through hole 57 of the restrictive flow element 45 and the connecting channel 59 of the restrictive flow element 45 is provided by the channel 58 of the throttle element 15.

However, to close the valve assembly 15/45, the throttle element 15 is rotated thereby rotating the channel 58 of the throttle element 15 out of communication with the connecting channel 59. Thus, in the position shown in FIG. 9, the through hole 57 and the connecting channel 59 are isolated from one another and communication between reservoir 41 and exit orifice 21 is prevented. To reestablish communication, the throttle element 15 is rotated back to the position shown in FIGS. 7 and 8 whereby the channel 58 provides communication between the through hole 57 and connecting channel 59.

FIG. 10 illustrates the relationship between the downwardly extending cylindrical wall 51 of the actuator 17 and the upwardly extending cylindrical wall 46 of the lower shell 13. The wall 46 of the shell 13 includes recesses 47. The wall 51 of the actuator 17 includes complementary protuberances 62 which are received within the recesses and provide a clicking sound when they either enter or exit a recess 47, thereby signaling to the consumer that the pad 18 is centrally located within the opening 27. The protuberances 62 of the wall 51 are illustrated in greater detail in the exploded view of FIG. 11. FIG. 11 also illustrates the complimentary truncated triangle cross section of the downwardly extending pegs 36 which fit between the adjacent absorbent pads 18 of the pad ring 33. As also shown in FIG. 11, the actuator 17 includes an inner cylindrical wall 64 that is mateably received within the cylindrical wall 46 of the lower shell 13. Thus, the wall 46 of the shell 13 is sandwiched between the walls 64 and 51 of the actuator 17. The recesses shown at 65, 66 in the shells 13, 14 accommodate the pump elements 49, 16 of the reservoir 41 respectively.

Another valve assembly **15*a*/45*a* is illustrated in FIGS. 12 and 13. Instead of a rotating throttle member 15*a*, the throttle member 15*a* moves axially with respect to the restrictive flow element 45*a*. Specifically, the restrictive flow element 45*a* also includes a cylindrical section 54*a* that terminates at an end wall 55*a* (See FIG. 13). The restrictive flow element also includes a through hole 57*a*. The through hole 57*a* provides communication between the reservoir 41 and the exit orifice 21*a* when the throttle element 15*a* has been moved axially away from the reservoir 41 or downward from the perspective shown in FIG. 13. In the position shown in FIG. 13, the through hole 57*a* is in communication with the connecting passageway 59*a* which, in turn, is in communication with the exit orifice 21*a* as shown in FIG. 13. In the closed position shown in FIG. 12, the through hole 57*a* is covered by the body of the throttle element 15*a* thereby preventing communication through the restrictive flow element 45*a***.

Turning to FIG. 14, yet another device **10*a* is disclosed with differently configured half shells 13*a*, 14*a* which may be connected to the reservoir 41*a* by fasteners (not shown) extending through the through-holes 71 of the tabs 72 of the reservoir 41*a* and complementary holes, only one of which is shown at 73 in behalf shell 13*a*. In this embodiment, the reservoir 41*a* and absorbent pad ring 33 may be replaced with relative ease. A label is shown at 74**.

FIG. 14 also discloses a different valve assembly which includes a throttle or tip **15*b*, a nozzle 75 which may be press-fit or permanently connected to the reservoir 41*a*, and a flow restrictor 76, typically fabricated from a polymer tubular material such as HDPE, one example of which is POREX®, having a 35 μm diameter flow path (not shown). The O-ring 77 provide to seal when the throttle or tip 15*b* is moved axially towards the reservoir 41*a***.

FIGS. 15-16 both show different styles of caps or covers **81*a*, 81*b* that may be employed for covering the absorbent pads 18. The cover 81*a* of the device 10*b* of FIG. 15 is equipped with a release handle 82 and release tab or catch 83 as well is a barbed leg 84. The cover 81*b* of the device 10*c* includes two nibs 85, 86 that simply snap into place as shown in FIG. 16**.

Thus, at least three types of valve assemblies 15/45, **15*a*/45*a*, 15*b*/77/75/76 are shown and described in detail. A simple cap or cover for the reservoir 41 with a small or restrictive opening will also suffice. The first valve assembly 15/45 includes a rotating throttle element 15 and the second and third types of valve assemblies 15*a*/45*a* and 15*b*/77/75/76 include a throttle element 15*a*, 15*b* that moves axially with respect to the restrictive flow element or nozzle 45*a*, 75**. However, other types of valve assemblies will be apparent to those skilled in the art as discussed above in the summary of the disclosure section.

The absorbent material 18 may be obtained from Filtrona Richmond, Inc. of Colonial Heights, Va. (http://www.filtronafibertec.com/BondedFiberComponents/). The fibers themselves may be fabricated from various polyesters, polypropylene, wool, polyolefins, cellulose acetates and other similar materials. Additional information regarding suitable fibers and absorbent pads may be obtained from the manufacturer. Polyester felt material has also been found to be useful and can be attained from a variety of different manufacturers.

The devices 10, 10*a* can be designed to be disposable or designed to have the reservoirs 41, 41*a* and/or the absorbent pad rings 33 replaceable.

Multi-purpose fluids are disclosed. Useful compositions are illustrated below in the following tables.

FORMULATIONS

| Function/Description | Chemical Name/Trade Name | Amount |
|---|---|---|
| Solvent | Deionized water | 90-95 wt % |
| Anionic Surfactant | sodium capryl sulfate | 0-1 wt % |
| Anionic Surfactant | Isopropylamine Sulfonate | 0-1 wt % |
| Nonionic Surfactant | Linear ethoxylated alcohols $C_{12-15}$ | 0-1 wt % |
| Preservative | PROXEL GXL | 0.1 wt % |
| Bleach | Hydrogen Peroxide (35%) | 0-4 wt % |

Additional ingredients can be utilized, such as those illustrated in the following table:

| Function/Description | Chemical Name/Trade Name | Amount |
|---|---|---|
| Solvent | Deionized water | 89.32-96.82 wt % |
| Solvent | Ethyl Alcohol, anhydrous | 0-7.5 wt % |
| Anionic Surfactant | STEPANOL WA-Extra PCK, sodium lauryl sulfate | 0-2 wt % |
| Anionic Surfactant | Isopropylamine Sulfonate | 0-0.2 wt % |
| Anionic Surfactant | Sodium capryl sulfonate (38%) | 0-0.2 wt % |
| Nonionic surfactant | LUTENSOL AO8, O—X—O alcohol ethoxylate | 0-1 wt % |
| Nonionic Surfactant | Linear ethoxylated alcohols $C_{12-15}$ | 0-0.2 wt % |
| Preservatives | PROXEL GXL | 0.1 wt % |
| pH Adjuster | Citric acid (50%) | 0.08 wt % |

Stepanol WA-Extra PCK is 28.95% sodium lauryl sulfate in water. Proxel GXL is a preservative. (EPA Registration No. 10182-30) manufactured by Zeneca AG Products, Inc.

Suitable exemplary formulations include but are not limited to:

EXAMPLE 1

| Function/Description | Chemical Name/Trade Name | Amount |
|---|---|---|
| Solvent | Deionized water | 99.3 wt % |
| Anionic Surfactant | sodium capryl sulfate | 0.2 wt % |

-continued

| Function/Description | Chemical Name/Trade Name | Amount |
|---|---|---|
| Anionic Surfactant | Isopropylamine Sulfonate | 0.2 wt % |
| Nonionic Surfactant | Linear ethoxylated alcohols $C_{12-15}$ | 0.2 wt % |
| Preservative | PROXEL GXL | 0.1 wt % |
| pH | | 8.8 |

EXAMPLE 2

| Function/Description | Chemical Name/Trade Name | Amount |
|---|---|---|
| Solvent | Deionized water | 96.54 wt % |
| Anionic Surfactant | sodium capryl sulfate | 0.2 wt % |
| Anionic Surfactant | Isopropylamine Sulfonate | 0.2 wt % |
| Nonionic Surfactant | Linear ethoxylated alcohols $C_{12-15}$ | 0.2 wt % |
| Bleach | Hydrogen Peroxide (35%) | 2.86 wt % |
| pH | | 8.8 |

Additional examples include:

EXAMPLE 3

| Function/Description | Chemical Name/Trade Name | Amount |
|---|---|---|
| Solvent | Deionized water | 96.82 to wt % |
| Solvent | Ethyl Alcohol, anhydrous | 0 wt % |
| Anionic Surfactant | STEPANOL WA-Extra PCK, sodium lauryl sulfate | 2 wt % |
| Anionic Surfactant | Isopropylamine Sulfonate | 0 wt % |
| Anionic Surfactant | Linear ethoxylated alcohols $C_{12-15}$ | 0 wt % |
| Anionic Suffactant | Sodium capryl sulfonate (38%) | 0 wt % |
| Nonionic surfactant | LUTENSOL AO8, O—X—O alcohol ethoxylate | 1 wt % |
| Nonionic Surfactant | Linear ethoxylated alcohols $C_{12-15}$ | 0 wt % |
| Preservatives | PROXEL GXL | 0.1 wt % |
| pH Adjuster | Citric acid (50%) | 0.08 wt % |
| Ph | | 6.5 |

EXAMPLE 4

| Function/Description | Chemical Name/Trade Name | Amount |
|---|---|---|
| Solvent | Deionized water | 89.32 wt % |
| Solvent | Ethyl Alcohol, anhydrous | 7.5 wt % |

-continued

| Function/Description | Chemical Name/Trade Name | Amount |
|---|---|---|
| Anionic Surfactant | STEPANOL WA-Extra PCK, sodium lauryl sulfate | 2 wt % |
| Anionic Surfactant | Isopropylamine Sulfonate | 0 wt % |
| Anionic Surfactant | Sodium capryl sulfonate (38%) | 0 wt % |
| Nonionic surfactant | LUTENSOL AO8, O—X—O alcohol ethoxylate | 1 wt % |
| Nonionic Surfactant | Linear ethoxylated alcohols $C_{12-15}$ | 0 wt % |
| Preservatives | PROXEL GXL | 0.1 wt % |
| pH Adjuster | Citric acid (50%) | 0.08 wt % |
| pH | | 6.4 |

EXAMPLE 5

| Function/Description | Chemical Name/Trade Name | Amount |
|---|---|---|
| Solvent | Deionized water | 91.8 wt % |
| Solvent | Ethyl Alcohol, anhydrous | 7.5 wt % |
| Anionic Surfactant | STEPANOL WA-Extra PCK, sodium lauryl sulfate | 0 wt % |
| Anionic Surfactant | Isopropylamine Sulfonate | 0.2 wt % |
| Anionic Surfactant | Sodium capryl sulfonate (38%) | 0.2 wt % |
| Nonionic surfactant | LUTENSOL AO8, O—X—O alcohol ethoxylate | 0 wt % |
| Nonionic Surfactant | Linear ethoxylated alcohols $C_{12-15}$ | 0.2 wt % |
| Preservatives | PROXEL GXL | 0.1 wt % |
| pH Adjuster | Citric acid (50%) | 0 wt % |

EXAMPLE 6

| Function/Description | Chemical Name/Trade Name | Amount |
|---|---|---|
| Solvent | Deionized water | 88.94 wt % |
| Solvent | Ethyl Alcohol, anhydrous | 7.5 wt % |
| Anionic Surfactant | STEPANOL WA-Extra PCK, sodium lauryl sulfate | 0 wt % |
| Anionic Surfactant | Isopropylamine Sulfonate | 0.2 wt % |
| Anionic Surfactant | Sodium capryl sulfonate (38%) | 0.2 wt % |
| Nonionic surfactant | LUTENSOL AO8, O—X—O alcohol ethoxylate | 0 wt % |
| Nonionic Surfactant | Linear ethoxylated alcohols $C_{12-15}$ | 0.2 wt % |
| Preservatives | PROXEL GXL | 0.1 wt % |
| pH Adjuster | Citric acid (50%) | 0 wt % |

-continued

| Function/Description | Chemical Name/Trade Name | Amount |
|---|---|---|
| Bleach/oxidant | Hydrogen peroxide (35%) | 2.86 wt % |

As the disclosed formulations are preferably for use "on-the-go," is important to keep residues at a minimum as residues would be visible on darker fabrics. Most nonionic surfactants lead some sort of residue and therefore it is important to keep the nonionic surfactants 3 wt % and preferably below 2 wt % and preferably below 1 wt %. For more powerful cleaning capability, the anionic surfactant amounts can be increased shown above. Citric acid can be used as a pH adjuster and therefore can be used to relatively small amounts, less than 1 wt %.

Preferred multi-use formulations include a combination of surfactants, including a plurality of anionic surfactants. While only one nonionic surfactant as shown above, a plurality of nonionic surfactants may be incorporated as well. Regarding the anionic surfactants, it will be noted that only a single anionic surfactant is necessary but the above combination has proven to be quite effective. In larger quantities, citric acid can be used as a stain removing agent but, in this example, citric acid is used to lower the pH.

The anionic surfactants may be selected from the group consisting of sodium lauryl sulfate, isopropyl amine sulfonate, sodium capryl sulfonate and mixtures thereof. Preferably, the anionic surfactants are provided in the form of a combination of sodium lauryl sulfate, isopropyl amine sulfonate, and sodium capryl sulfonate. Suitable anionic surfactants may further be selected from the group consisting of alkyl sulfates, alkyl ethoxy sulfates (AES) such as NaAES and $NH_4$AES, amine oxides, and mixtures thereof. The alkyl sulfate surfactants may include branched-chain and random $C_{10}$-$C_{20}$ alkyl sulfates, and $C_{10}$-$C_{18}$ secondary (2,3) alkyl sulfates of the formula $CH_3(CH_2)_x(CHOSO_3M^+)CH_3$ and $CH_3(CH_2)_y(CHOSO_3M^+)CH_2CH_3$ where x and (y+1) are integers of at least 7, preferably at least 9, and M is a water-solubilizing cation, especially sodium, as well as unsaturated sulfates such as oleyl sulfate. Alkyl ethoxy sulfate (AES) surfactants used herein are conventionally depicted as having the formula $R(EO)_xSO_3Z$, wherein R is $C_{10}$-$C_{16}$ alkyl, $(EO)_x$ is $(CH_2CH_2O)_x$, x is 1-10 and can include mixtures which are conventionally reported as averages, e.g., $(EO)_{2.5}$, $(EO)_{6.5}$ and the like, and Z is a cation such as sodium ammonium or magnesium (MgAES). The $C_{12}$-$C_{16}$ alkyl dimethyl amine oxide surfactants can also be used.

Nonionic surfactants should have a HLB value in the range of 9-17 and may include but are not limited to: the ethoxylated octylphenols; ethoxylated fatty alcohols, including the ethoxylated primary fatty alcohols; ethoxylated secondary fatty alcohols; ethoxylated nonylphenols; ethoxylated sorbitan fatty acid esters; sorbitan fatty acid esters; linear ethoxylated ethoxylated alcohols; O—X—O alcohol ethoxylates; and mixtures thereof.

Optional chelating agents include but are not limited to: lactic acid; the salts of ethylenediamine tetraacetic acid (EDTA), such as ethylenediamine tetraacetic acid disodium salt, ethylenediamine tetraacetic acid diammonium salt, ethylenediamine tetraacetic acid trisodium salt, ethylenediamine tetraacetic acid tetrasodium salt, ethylenediamine tetraacetic acid tetrapotassium salt, ethylenediamine tetraacetic acid tetrammonium salt and the like; the salts of diethylenetriaminepentaacetic acid (DTPA), such as diethylenetriaminepentaacetic acid pentapotassium salt and the like; the salts of (N-hydroxyethyl) ethylenediaminetriacetic acid (HEDTA), such as (N-hydroxyethyl) ethylenediaminetriacetic acid trisodium salt, (N-hydroxyethyl) ethylene-diaminetriacetic acid tripotassium salt and the like; the salts of nitrilotriacetic acid (NTA), such as nitrilotriacetic acid trisodium salt, nitrilotriacetic acid tripotassium salt and the like; other chelating agents such as triethanolamine, diethanolamine, monoethanolamine and the like, and mixtures thereof. However, because of its low cost and effectiveness, the preferred chelating agent is citric acid.

To maintain the VOC level below the maximum allowed by certain federal and state regulations, if ethanol is used at all, the ethanol content should not exceed 7.5 wt %. D-limonene can also be used with water instead of or in combination with ethanol. The cumulative amount of anionic surfactants should not exceed 3 wt %. Only small amounts of anionic surfactant are necessary.

Other optional ingredients include limonene and greater amounts of citric acid. Small amounts of a bleaching agent, such as hydrogen peroxide, may also be employed. While the above formulation works well without a chelating agent, chelating agents have been proven to be effective in many formulations and their inclusion is not discouraged.

Aqueous-Formulation for Everyday Stains:

| Function/Description | Chemical Name | Amount |
|---|---|---|
| Nonionic surfactant | | 0.1-1 wt % |
| Anionic surfactant | | 0.1-.75 wt. % |
| Solvent | D-limonene | 0.1-0.5 wt. % |
| Chelating agents | | 0.1-0.5 wt. % |
| Preservative | | |
| Fragrance | | |

Like the multiple-the use formulation disclosed above, the nonionic surfactant and anionic surfactant can be combinations of various Nonionic and anionic surfactants respectively. Instead of or in addition to ethanol as a solvent, D-limonene can be used as it is excellent cleaning properties. Chelating agents may also be employed.

Aqueous Formulation for Blood, Ink and Greasy Foods:

| Function/Description | Chemical Name | Amount |
|---|---|---|
| Nonionic surfactant | | 0.1-2 wt % |
| Anionic surfactant | | 0.1-.75 wt % |
| Solvent | D-limonene | 0.1-0.5 wt % |
| Solvent | Alcohol (e.g. EtOH) | 0.1-7.5 wt % |
| Chelating agents | | 0.1-0.5 wt % |
| Bleach (Hydrogen Peroxide | Hydrogen Peroxide | 0.1-1.5 wt % |
| Preservative | | |
| Fragrance | | |

Again, the primary difference between the above formulation and that for "everyday stains" is the inclusion of the bleaching agent, hydrogen peroxide.

While only certain embodiments have been set forth, alternatives and modifications will be apparent from the above description to those skilled in the art. These and other alternatives are considered equivalents and within the spirit and scope of this disclosure and the appended claims.

What is claimed:

1. An applicator for applying stain treatment fluid to fabric, comprising:

a fluid reservoir disposed between and connected to a valve assembly and a shell, the fluid reservoir in communication with the valve assembly and isolated from the shell, the fluid reservoir containing a stain treatment formulation, the shell accommodating a ring of absorbent pads, the shell comprising an opening opposite the shell from the reservoir through which an absorbent pad is extended, the shell being rotatably connected to an actuator that engages the ring of absorbent pads, rotation of the actuator causing the ring of absorbent pads to rotate inside the shell, and the valve assembly comprising an exit orifice.

2. The applicator of claim 1 wherein the absorbent pads comprise matted fibers.

3. The applicator of claim 1 wherein the absorbent pads comprise polyester felt.

4. The applicator of claim 1 wherein the valve assembly further comprises a restrictive flow element providing communication between the reservoir and a throttle element, the exit orifice being disposed in the throttle element, the restrictive flow element being disposed axially within the throttle element, the throttle element being movable with respect to the restrictive flow element.

5. The applicator of claim 4 wherein rotation of the throttle element about the restrictive flow element establishes or prevents communication between the reservoir and the exit orifice.

6. The applicator of claim 4 wherein axial movement of the throttle element with respect to the restrictive flow element establishes or prevents communication between the reservoir and the exit orifice.

7. The applicator of claim 4 wherein one end of the restrictive flow element is mateably received within an opening in the reservoir and an opposing end of the restrictive flow element is mateably received within the throttle element.

8. The applicator of claim 4 wherein the reservoir is disposed between the shell and the restrictive flow element and the restrictive flow element is disposed between the reservoir and the throttle element.

9. The applicator of claim 1 wherein the stain treatment fluid comprises water, at least one anionic surfactant, and at least one nonionic surfactant.

10. The applicator of claim 9 wherein the least one anionic surfactant is selected from the group consisting of sodium lauryl sulfate, isopropyl amine sulfonate, sodium capryl sulfonate and mixtures thereof.

11. The applicator of claim 9 wherein the nonionic surfactant is selected from the group consisting of an alcohol ethoxylate, a linear ethoxylated alcohol, and mixtures thereof.

12. The applicator of claim 10 wherein the stain treatment fluid further comprises a bleach.

13. The applicator of claim 12 wherein the bleache comprises hydrogen peroxide.

14. A fabric treatment application device comprising:

a reservoir disposed between and connected to both a valve assembly and a shell, the reservoir being in fluid communication with the valve assembly and isolated from the shell, the reservoir containing a stain treatment formulation, the shell accommodating a ring of absorbent pads and an opening through which at least one of the absorbent pads extends, the shell being rotatably connected to an actuator that engages the ring of absorbent pads, rotation of the actuator causing the absorbent pads to rotate inside the shell, the valve assembly comprising a restrictive flow element providing communication between the reservoir and a throttle element, the throttle element comprising an exit orifice, the restrictive flow element being disposed axially within the throttle element, the throttle element being rotatable with respect to the restrictive flow element, wherein movement of the throttle element with respect to the restrictive flow element establishes or prevents communication between the reservoir and the exit orifice.

15. The fabric treatment application device of claim 14 wherein rotation of the throttle element about the restrictive flow element establishes or prevents communication between the reservoir and the exit orifice.

16. The fabric treatment application device of claim 14 wherein axial movement of the throttle element with respect to the restrictive flow element establishes or prevents communication between the reservoir and the exit orifice.

* * * * *